United States Patent [19]

LaRoche et al.

[11] Patent Number: 4,866,898

[45] **Date of Patent: * Sep. 19, 1989**

[54] FIRE RESISTANT EXPANSION JOINT

[75] Inventors: Allan R. LaRoche, Roseville, Calif.; Douglas S. Pearmain, Auburn, Me.

[73] Assignee: Manville Corporation, Denver, Colo.

[ * ] Notice: The portion of the term of this patent subsequent to Jul. 18, 2006 has been disclaimed.

[21] Appl. No.: 208,696

[22] Filed: Jun. 20, 1988

[51] Int. Cl.[4] ..... E04B 1/74

[52] U.S. Cl. ..... 52/396; 52/403; 52/573

[58] Field of Search ..... 52/396, 403, 573, 317; 165/131, 81; 404/53, 54, 56, 68, 69

[56] References Cited

U.S. PATENT DOCUMENTS

| | | | |
|---|---|---|---|
| 1,357,713 | 11/1920 | Lane | 52/395 X |
| 3,300,913 | 1/1967 | Patry et al. | 52/94 X |
| 3,581,450 | 6/1971 | Patry | 52/403 X |
| 3,694,976 | 10/1972 | Warshaw | 52/403 X |
| 3,722,933 | 3/1973 | Nute, Jr. | 52/273 X |
| 3,786,604 | 1/1974 | Kramer | 52/573 X |
| 3,846,031 | 11/1974 | Adams | 52/484 X |
| 3,849,958 | 11/1974 | Balzer et al. | 52/573 X |
| 4,030,852 | 6/1977 | Hein | 52/396 X |
| 4,058,328 | 11/1977 | Nickerson et al. | 285/45 X |
| 4,189,877 | 2/1980 | Jentoff et al. | 52/573 X |
| 4,517,779 | 5/1985 | Dunsworth | 52/573 X |
| 4,566,242 | 1/1986 | Dunsworth | 52/573 X |
| 4,649,129 | 3/1987 | Dunsworth | 502/237 X |
| 4,663,894 | 5/1987 | LaRoche et al. | 52/396 X |
| 4,750,301 | 6/1988 | Croxford | 52/573 X |

*Primary Examiner*—David A. Scherbel
*Assistant Examiner*—Lan Mai
*Attorney, Agent, or Firm*—John D. Lister; Cornelius P. Quinn; Gregory A. Evearitt

[57] ABSTRACT

An expansion joint having a weather resistant cover and a fire barrier. The cover is a bellows attached to the upper surface of the adjacent joint structure by mounting flanges, and the barrier is a fire resistant inorganic fabric sheet mounted in the joint. The fabric supports resilient fire resistant inorganic fibrous insulation and is connected to the adjacent joint structure by mounting flanges. The flanges may be in the form of a bifurcated clamp, and one of the fabric-engaging clamp faces may be crimped and pierced to better grip the fabric.

6 Claims, 2 Drawing Sheets

FIRE RESISTANT EXPANSION JOINT

FIELD OF THE INVENTION

This invention relates generally to expansion joints. More particularly, it relates to fire resistant expansion joints.

BACKGROUND OF THE INVENTION

Building structures often incorporate expansion joints to accommodate the movement of structural elements as a result of temperature changes or seismic activity. Local building codes in addition often require expansion joints to meet minimum requirements for fire resistance. This means that the fire barrier assembly used to close the expansion joint opening must not only be capable of accommodating movement, but must in addition be capable of resisting flame penetration while limiting heat rise through the joint to the level prescribed in the code. When the expansion joint is part of the building envelope it must also be weather proof.

Prior attempts to provide suitable fire barrier assemblies have not been satisfactory from an economical point of view because they are either too costly to manufacture or too labor intensive to install. An example of prior art methods of providing a weather proof fire resistant expansion joint can be found in U.S. Pat. No. 4,517,779 to Dunsworth. This patent discloses a joint cover comprising a hollow barrier which allows the relatively movable structural elements beneath it to slide along the bottom surface of the cover. The hollow cavity of the cover contains a hygroscopic material that releases coolant liquid by a wicking process when the barrier assembly is exposed to high temperatures. In addition, a separate smoke barrier in the form of flexible refractory cloth is employed. It is apparent that an installed assembly of this type is quite expensive.

A simpler arrangement is disclosed in U.S. Pat. No. 4,566,242 to Dunsworth wherein a slide plate covers the void between adjacent floors in an internal expansion joint assembly. A refractory fiber cloth jacket functions as a smoke barrier and as a support for refractory insulation which acts as a heat barrier. While this arrangement is considerably simpler in design and less expensive than the assembly of U.S. Pat. No. 4,517,779, it is designed for use as an internal expansion joint rather than an external expansion joint, is not weather resistant, and requires the refractory cloth and insulation to be quite wide in order to extend out to the lower legs of the clamping brackets 22 and 24. This results in the smoke and heat barrier assembly costing still more than desired. Further, the installation of the assembly, which requires the clamping brackets to be bolted to the floor sections and the grout faces, is still more labor intensive than desired. In addition, penetration of the refractory material by the bolts introduces an unwanted source of heat transmission.

It would obviously be beneficial to have a fire resistant expansion joint design which not only performs the functions required of it but which also has a relatively low installed cost as a result of economies of manufacture and the ability to rapidly install the system.

SUMMARY OF THE INVENTION

This invention provides an expansion joint fire barrier which comprises an elongated flexible fire resistant sheet the side edges of which are attached to mounting flange means. Each mounting flange means is connected to one of the spaced relatively movable members which defines the expansion joint to thereby support the flexible sheet between the spaced members. The flexible sheet, which is curved across its width to accommodate movement of the spaced members, supports resilient fire resistant insulation. The combination of the flexible sheet and the resilient insulation functions as a barrier to flame and to excessive heat rise.

By locating the portion of the mounting flange which is attached to the flexible sheet in the space between the spaced members, the side edges of the flexible sheet are able to terminate within the space, thus considerably reducing the required width of the sheet and of the insulation supported thereon. Preferably, the sheet is connected to the mounting flanges by means of bifurcated clamps, which facilitates this arrangement. At least one of the gripping surfaces of each bifurcated clamp preferably comprises a crimped portion which contacts the associated edge portion of the flexible sheet, thereby providing a highly efficient clamping or gripping mechanism for holding the flexible sheet in place without the need to attach the sheet to the top surface of the spaced movable members. In addition to the use of a crimped portion the flange may be pierced to form gripping teeth, as disclosed in more detail in Application Ser. No. 900,936, filed Oct. 17, 1986, now U.S. Pat. No. 4,750,301, dated June 14, 1988, and assigned to the assignee of this application.

In a preferred embodiment the flexible fire resistant sheet comprises an inorganic fabric including silica fibers, and the resilient insulation comprises an inorganic fibrous layer including refractory fibers.

The expansion joint cover used in conjunction with the fire barrier comprises an elongated flexible bellows which is attached by means of mounting flanges connected to the spaced members of the expansion joint so that the bellows covers the space between the members.

This arrangement provides all the functions required of a fire resistant expansion joint and in addition is economical to manufacture and relatively simple and fast to install, thus meeting all the goals of the invention.

Other features and aspects of the invention, as well as other benefits of the invention, will readily be ascertained from the more detailed description of the invention which follows.

DESCRIPTION OF THE PREFERRED EMBODIMENTS

Figure 1:
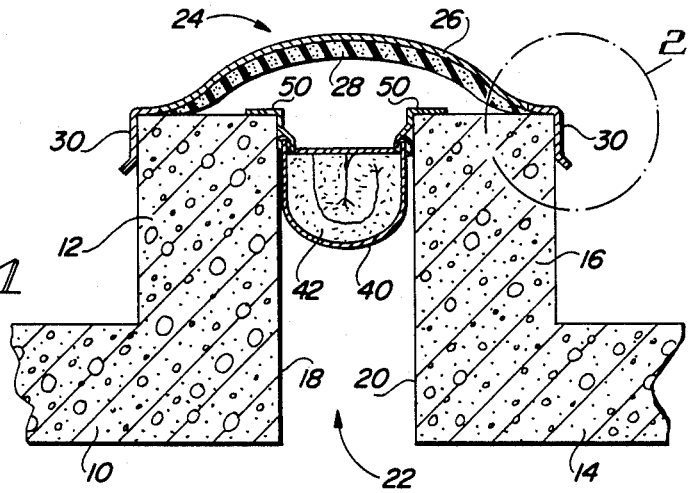
FIG. 1 is a partial transverse sectional view of the expansion joint of the present invention, illustrating the joint cover and the fire barrier assembly.

Referring to FIG. 1, roof section 10 and parapet 12 of a building structure are spaced from roof section 14 and parapet 16 of the same structure. The space between the resulting opposed interior surfaces 18 and 20 forms an expansion joint 22 which is protected from the elements by waterproof cover 24. The cover 24 comprises a bellows or sheet of waterproof material 26, such as a suitable elastomeric membrane, overlying a layer of plastic foam 28 provided for bellows support. The foam may conveniently take the form of closed cell polyethylene foam. A similar bellows and bellows support product is produced by Manville Corporation under the name of EXPAND-O-FLASH.

Figure 2:
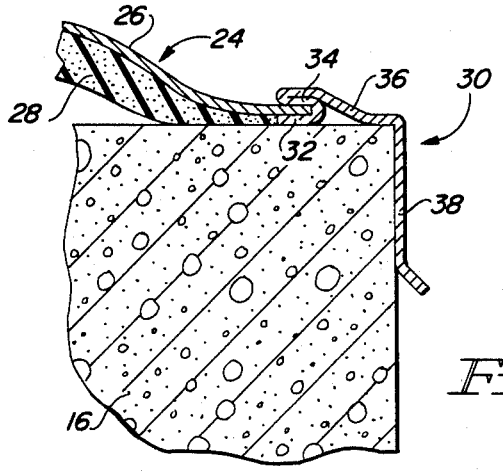
FIG. 2 is an enlarged partial transverse sectional view taken through the right flange and connected edge portion of the bellows of the expansion joint cover shown in FIG. 1.

The ends of the sheet 26 are attached to mounting flanges 30 which are connected to the parapets 12 and 16 adjacent the outermost corners thereof. As shown in more detail in FIG. 2, the end of the sheet 26 extends beyond the end of the foam layer 28 and is received between opposed segments 32 and 34 of the leg 36 of flange 30. The opposed segments 32 and 34 are formed as a result of reverse folding operations on the end portion of the flange leg 36, which are well known in the art and need not be described in detail herein. Preferably, the flange includes a leg 38 extending at right angles to the leg 36 so that the juncture between the legs coincides with the outer upper corner of the parapet 16.

Figure 3:
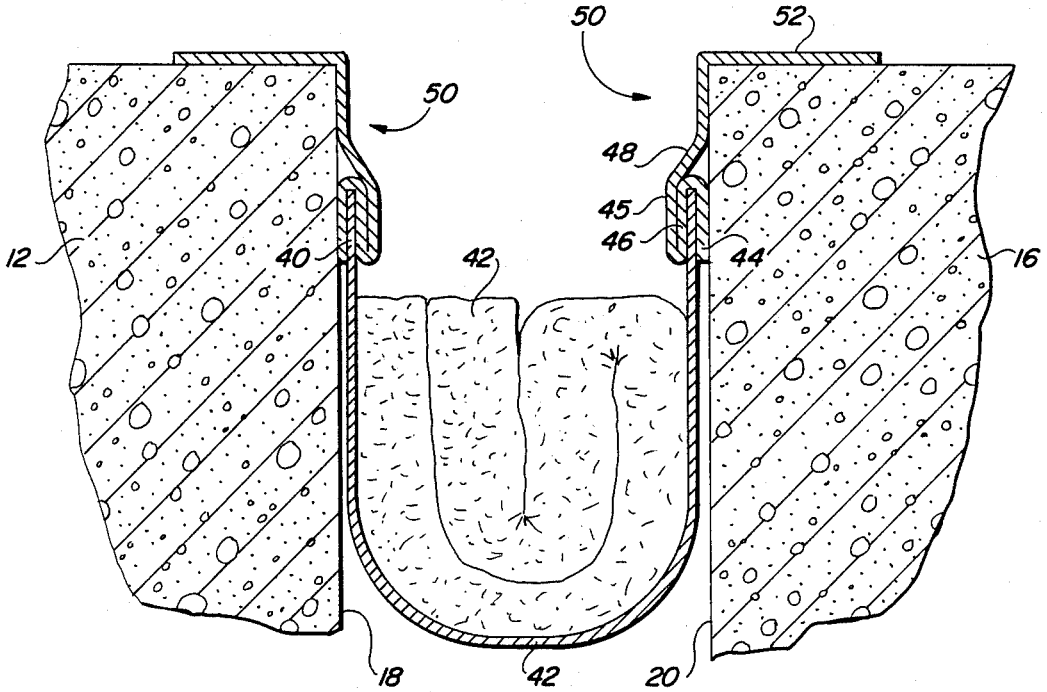
FIG. 3 is an enlarged partial transverse sectional view showing the fire barrier assembly in more detail.

Referring now to FIGS. 1 and 3, the expansion joint contains a fire barrier mounted between the surfaces 18 and 20. The fire barrier consists of a flexible fire resistant sheet 40 supporting resilient fire resistant insulation 42. The ends of the flexible sheet 40 are gripped between opposed segments 44 and 46 of the leg 48 of mounting flange 50. The opposed segments 44 and 46 may be formed by a folding operation similar to the process by which the flange 30 was folded, comprising opposed faces of a bifurcated clamp arrangement. In such an arrangement the segment 46 is in back-to-back relationship with the segment 45 which extends directly from the flange leg 48. If desired, in addition to the clamping pressure exerted by the folded flange segments, suitable adhesive may also be used to assist in holding the flexible sheet in place. The leg 48 of the flange 50 engages the interior surface 20 of the parapet 16 while the leg 52, which extends at right angles to the leg 48, engages the upper surface of the parapet 16 so that the juncture between the legs 48 and 52 meet at the upper inside corner of the parapet. A similar arrangement exists at the other parapet with the other flange 50.

The flexible sheet 40 may comprise any suitable material which is resistant to flame, such as refractory cloth which is readily available from a number of sources. A high temperature silica fiber fabric is a preferred material because of its good performance in these areas. Although only a single thickness of fabric is shown in the drawings, it will be understood that multiple layers may be used wherever additional heat or flame resistance is required or where the function of a smoke barrier requires it.

Any suitable fire resistant insulation may be used as long as it is resilient to a degree which permits it to be compressed when the spaced members 12 and 16 of the expansion joint move toward each other and to spring back when the spaced members move away from each other. A fire resistant fibrous insulation such as a layer or blanket formed of refractory fibers is preferred because it possesses these necessary properties and is readily availability. An example of such material is a product produced by Manville Corporation and sold under the name CERABLANKET. Because refractory fiber blankets are available in certain thicknesses only, it may be necessary to use multiple layers of blankets in order to provide the desired degree of fire protection. For example, if a two-hour rating of the joint is desired, a depth of four inches of 4 pcf insulation would be required, and for a four-hour rating a depth of six inches would be required. It should be understood that the term "refractory fibers" is intended to include fibers often referred to as "ceramic fibers".

Referring to FIG. 3, it will be seen that the fabric or flexible sheet 40 hangs from the mounting flanges 50 to form an open channel or trough in which the insulation 42 is supported. This arrangement is quite suitable for horizontal installations where there is no danger of the insulation 42 being dislodged from the fabric channel.

Figure 4:
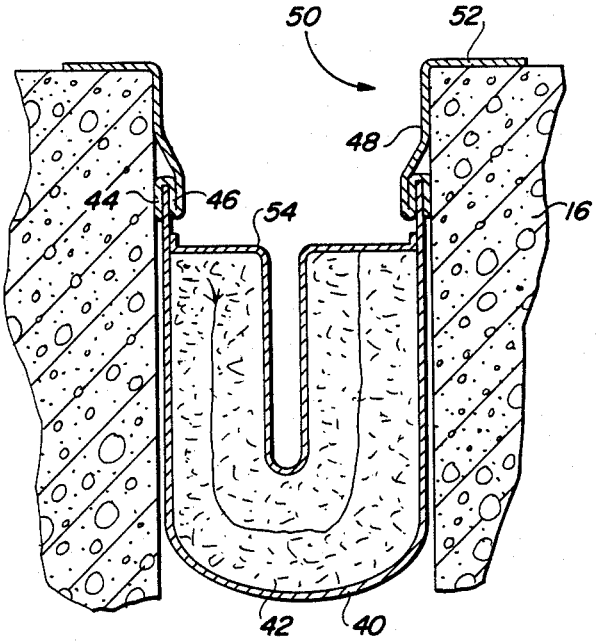
FIG. 4 is a view similar to that of FIG. 3, but showing a modified arrangement incorporating a second flexible sheet for encapsulating the resilient insulation.

Referring to FIG. 4, it will be seen that an upper horizontal strip 54 of the fabric has been provided. The strip 54, which connects the upper vertical portions of the flexible sheet just below the bifurcated clamp portions of the flanges 50, functions in combination with the sheet 40 to encapsulate the insulation. The sheets 40 and 54 are thus able to hold the insulation blankets 42 in place in installations where the insulation may be dislodged from the open channel arrangement of FIG. 3, such as in a vertical installation. The ends of the strip 54 are joined to the vertical portions of the sheet 40 by any suitable means such as by sewing or by otherwise bonding the two together.

Figure 5:
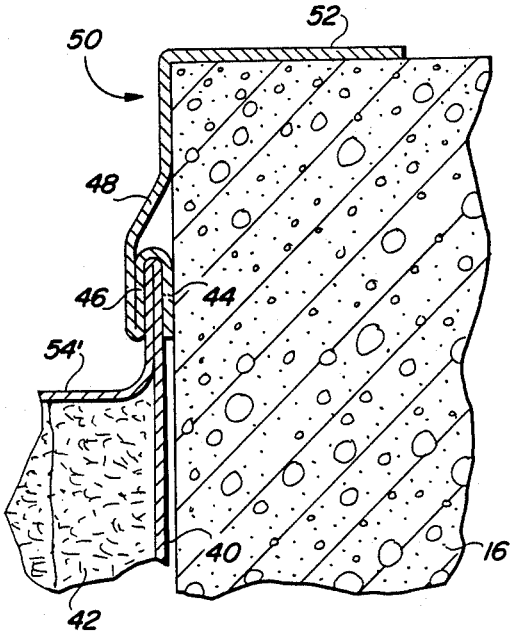
FIG. 5 is an enlarged partial sectional view taken through the right flange and connected edge portion of the fire resistant flexible sheet of the FIG. 4, but showing a modified arrangement incorporating two flexible sheets.

The strip may also be connected in a different manner, as illustrated in FIG. 5. In this arrangement the strip 54' is not joined directly to the upper vertical portion of the sheet 40 but extends up into the bifurcated clamp portion of the flange leg 48, where it is disposed in face-to-face contact with the upper end portion of the sheet 40 and is gripped in the same manner as the upper end portion of the sheet.

Figure 6:
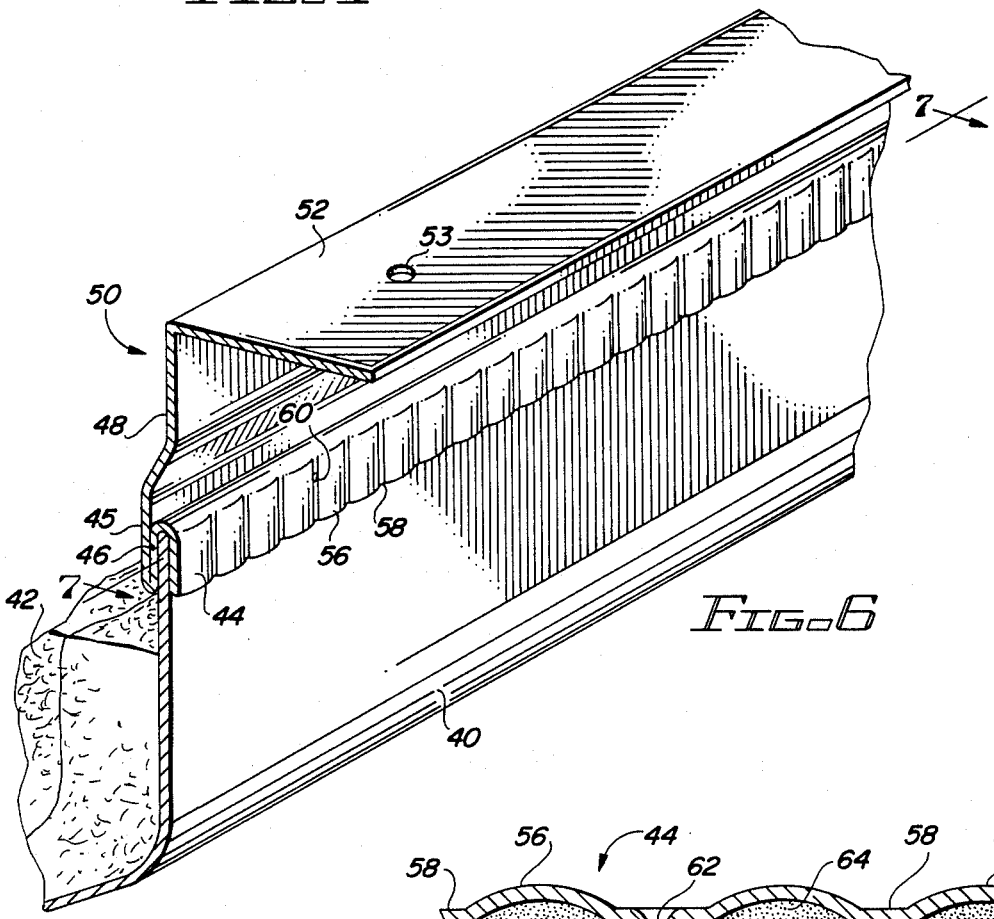
FIG. 6 is a partial pictorial view of a mounting flange and connected flexible fire resistant sheet, showing the preferred bifurcated clamp design of the mounting flange.

Referring to FIG. 6, the leg 52 of the mounting flange 50 contains regularly spaced preformed holes 53, only one of which is shown, for receiving mechanical fasteners used to attach the flange to the outer surface of the parapets. In addition, the bifurcated clamp employed to grip the end portions of the sheet 40 preferably includes a corrugated or crimped clamping member. In the embodiment illustrated the clamping segment 44 has been crimped to form corrugations 56 and valleys 58. The segment 44 has further been pierced in a valley as at 60 in order to provide a better grip between the bifurcated clamp and the sheet.

Figure 7:
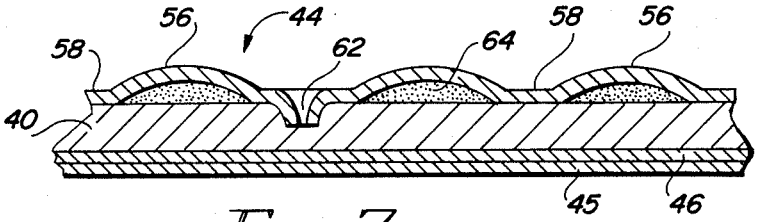
FIG. 7 is an enlarged sectional view taken on line 7—7 of FIG. 6, showing the detailed arrangement of the bifurcated clamp of FIG. 6 and the flexible sheet gripped thereby.

As shown in more detail in FIG. 7, the sheet 40 is held between clamp segments 44 and 46, with the valley portions 58 of segment 44 tightly gripping the sheet. The piercing operation results in the formation of teeth 62 which function to frictionally grip or even slightly penetrate the surface of the sheet 40 without, however, penetrating entirely through the sheet. These teeth aid in the gripping of the sheet, especially if the adhesive 64, shown as being located primarily between the sheet 40 and the corrugations 56, tends to cause slippage between the segment 44 and the sheet 40 prior to the final setting of the adhesive. For more information on this arrangement, reference may be had to the aforementioned Application Ser. No. 900,936, filed Oct. 17, 1986 and now U.S. Pat. No. 4,750,301.

It should now be clear that the present invention provides a simple, economical and highly effective fire resistant expansion joint due to a number of characteristics. The width of the flame barrier has been considerably reduced as a result of attachment means which allow the side edges of these elements to be located adjacent the boundaries of the expansion joint space. This arrangement is enhanced by the gripping engagement of the flexible sheet or fabric by the bifurcated clamp. The efficiency and effectiveness of the clamp itself is further increased by the use of adhesive and gripping teeth within the jaws of the bifurcated clamp. The arrangement of elements in the invention further permits the flame barrier to be quickly installed prior to the installation of the weather proof expansion joint cover so that neither installation interferes with the other.

It should now be understood after reading the foregoing description that the invention is not necessarily limited to all the specific structural details described, but that changes to certain features of the preferred embodiments which do not affect the overall function and concept of the invention may be made by those skilled in the art without departing from the spirit and scope of the invention, as defined in the appended claims.

What is claimed is:

1. In an expansion joint having spaced members subject to relative trasverse movement, a fire barrier comprising:

an elongated flexible fire resistant sleeve having side edge portions;

mounting flange means attached to the side edge portions of the flexible sleeve;

each mounting flange means being connected to one of the spaced members to support the flexible sleeve adjacent the spaced members; and resilient fire resistant insulation contained within the sleeve;

the flexible sleeve being curved across its width to accommodate movement of the space members away from each other.

2. An external weather resistant expansion joint between two spaced members subject to relative transverse movement, comprising:

an elongated flexible bellows having side edge portions;

means connecting the side edge portions of the bellows to the spaced members so that the bellows covers the space between the spaced members and extends upwardly from the spaced members, thereby protecting the space against the entry of water;

an elongated flexible fire resistant sheet having side edge portions;

mounting flange means attached to the side edge portions of the flexible sheet;

each mounting flange means being connected to one of the spaced members to support the flexible sheet between the spaced members and beneath the bellows; and resilient fire resistant insulation supported by the flexible sheet;

the flexible sheet being curved across its width to accommodate movement of the spaced members away from each other.

3. An expansion joint according to claim 2, wherein the means connecting the side edge portions of the bellows to the spaced members comprises mounting flange means attached to the associated side edge portion of the bellows, each such mounting flange means being connected to one of the spaced members.

4. An expansion joint according to claim 3, wherein the flexible fire resistant sheet comprises an inorganic fabric, and wherein the resilient fire resistant insulation comprises inorganic fibrous insulation.

5. An expansion joint according to claim 3, wherein the flexible fire resistant sheet comprises a sleeve, the resilient fire resistant insulation being contained within the sleeve.

6. An expansion joint according to claim 4, wherein the inorganic fabric comprises refractory fibers and the inorganic fibrous insulation comprises refractory fibers.

* * * * *

UNITED STATES PATENT AND TRADEMARK OFFICE

CERTIFICATE OF CORRECTION

PATENT NO. : 4,866,898

DATED : September 19, 1989

INVENTOR(S) : Allan Raymond LaRoche et al

It is certified that error appears in the above—identified patent and that said Letters Patent is hereby corrected as shown below:

Column 5, line 35, "trasverse" should be -transverse-

Column 6, line 2, "space" should be -spaced-

Signed and Sealed this

Eleventh Day of September, 1990

*Attest:*

HARRY F. MANBECK, JR.

*Attesting Officer*

*Commissioner of Patents and Trademarks*